United States Patent [19]

Ijima

[11] 4,231,680

[45] * Nov. 4, 1980

[54] BREAKWATERS

[75] Inventor: Takeshi Ijima, Fukuoka, Japan

[73] Assignee: Iida Kensetsu Kabushiki Kaisha, Fukuoka, Japan

[ * ] Notice: The portion of the term of this patent subsequent to May 15, 1996, has been disclaimed.

[21] Appl. No.: 846,388

[22] Filed: Oct. 28, 1977

[51] Int. Cl.[2] ..... E02B 3/06

[52] U.S. Cl. ..... 405/31; 405/35; 405/286

[58] Field of Search ..... 61/4, 37, 39, 49; 405/30, 31, 35, 284, 286, 287

[56] References Cited

U.S. PATENT DOCUMENTS

| | | | |
|---|---|---|---|
| 1,353,001 | 9/1920 | Uriarte | 61/4 |
| 2,827,769 | 3/1958 | Hunter | 61/4 |
| 3,118,282 | 1/1964 | Jarlan | 61/4 |
| 3,387,458 | 6/1968 | Jarlan | 405/31 |
| 3,490,239 | 1/1970 | Vincent | 61/4 |
| 3,995,434 | 12/1976 | Kato et al. | 61/4 |
| 4,154,548 | 5/1979 | Ijima | 405/30 |

FOREIGN PATENT DOCUMENTS

| | | | |
|---|---|---|---|
| 864954 | 5/1941 | France | 61/49 |
| 915057 | 1/1963 | United Kingdom | 61/49 |

*Primary Examiner*—David H. Corbin

*Attorney, Agent, or Firm*—Lackenbach, Lilling & Siegel

[57] ABSTRACT

In a breakwater which comprises a back wall, and at least one front wall pierced with holes to break up the impact of an incident wave, the improvements are proposed of providing a sloping back wall; of providing convex-concave indentations on the back wall; and of providing partitions to divide up the space between the back wall and the front wall or walls. Various embodiments include an embodiment with two front walls in which the holes in the rearmost front wall are smaller than the holes in the foremost front wall.

16 Claims, 16 Drawing Figures

FIG. 4
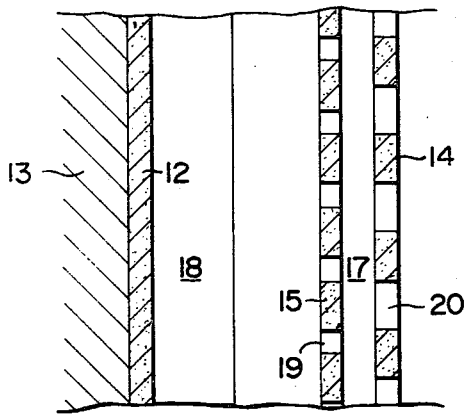
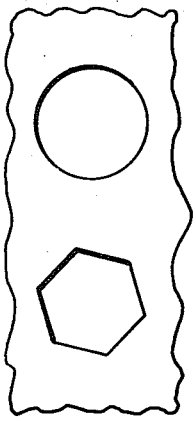
FIG. 17
FIG. 5
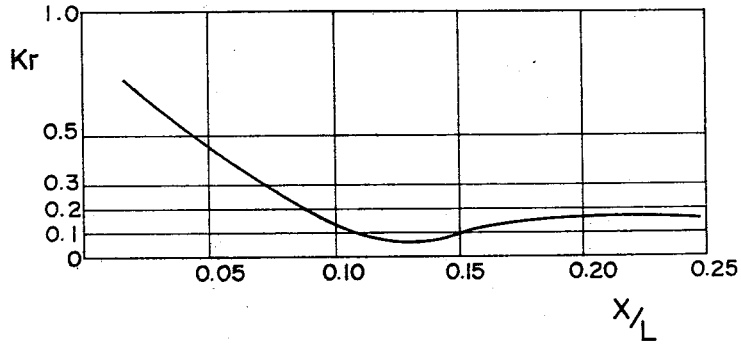
FIG. 6
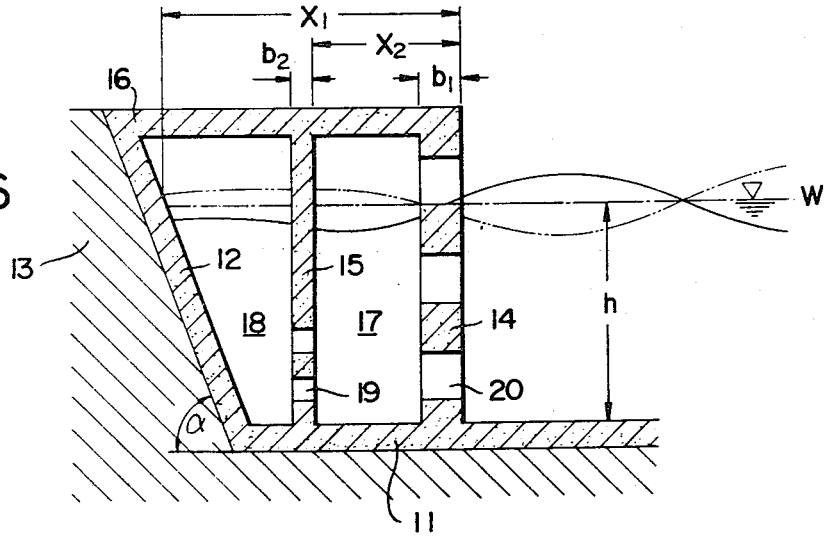

BREAKWATERS

This invention relates to a sea wall which is capable of blocking a variety of waves having a wide range of wavelengths and is applicable to a breakwater or the like.

In general, along the edge of the water in a harbour there is built up a sea wall having a planar uniform vertical front surface. In this case, however, an incident wave is reflected by the wall directly. Accordingly, the height of the wave in front of the wall becomes extremely large because of the overlap of the incident and the reflected waves, which is inconvenient for navigation of ships, loading, unloading, or the like. Furthermore, the impact of the wave against the wall is large.

A sea wall has been proposed as shown in FIGS. 1 to 3. However, such a wall has defects that the blocking ability is not enough against water including a variety of waves having a wide range of wavelengths.

It is an object of the present invention to provide a sea wall having effective blocking ability against a variety of waves having a wide range of wave lengths.

This object is accomplished by a sea wall including an inclined back wall.

Further objects, features, and advantages of the present invention will be apparent from the following description of the prior art and the present invention when taken in connection with the accompanying drawings, in which:

FIG. 1 is a transverse sectional view of a conventional sea wall;

FIG. 2 graphically illustrates the blocking ability of a conventional sea wall;

FIG. 4 is a sectional plan view of the sea wall of FIG. 3 taken along the line IV—IV;

Figure 3:
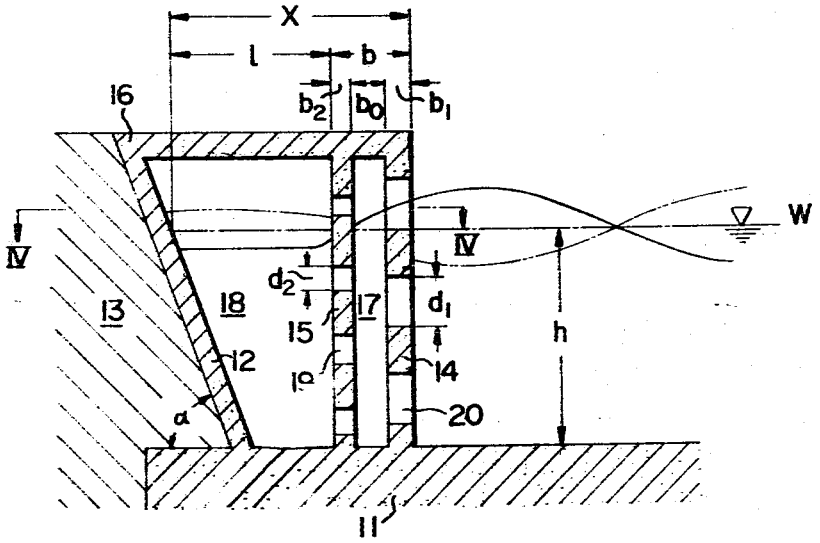
FIG. 3 is a transverse sectional view of a sea wall according to the present invention.
Figure 7:
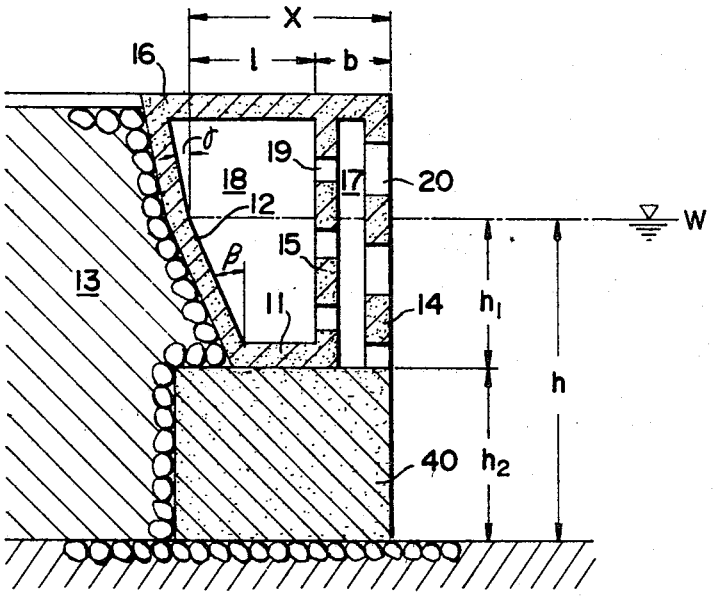
Figure 8:
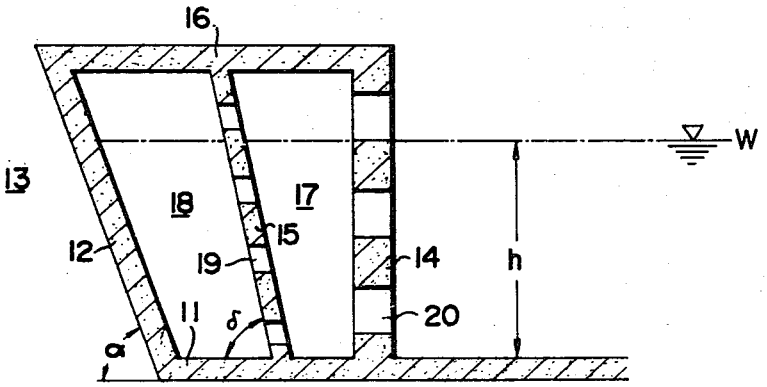
Figure 9:
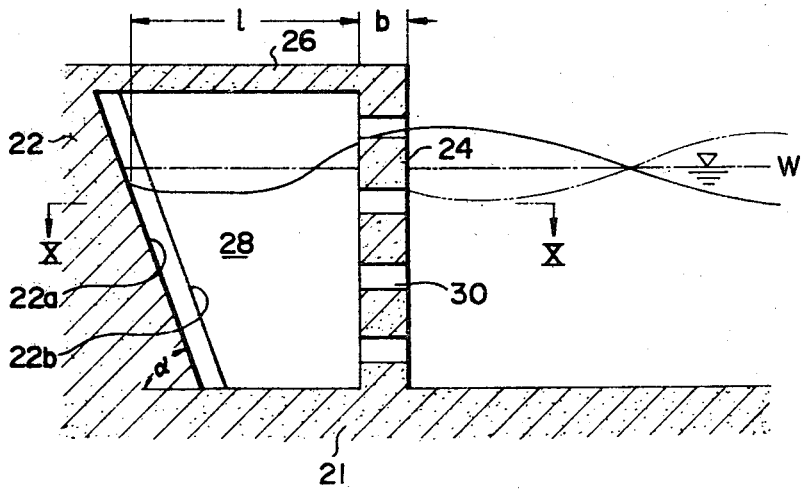
Figure 10:
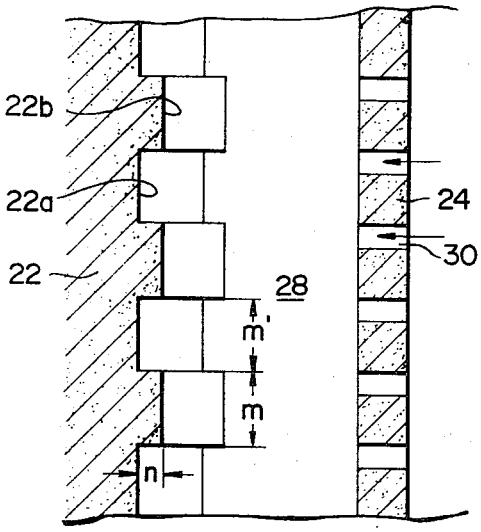
Figure 11:
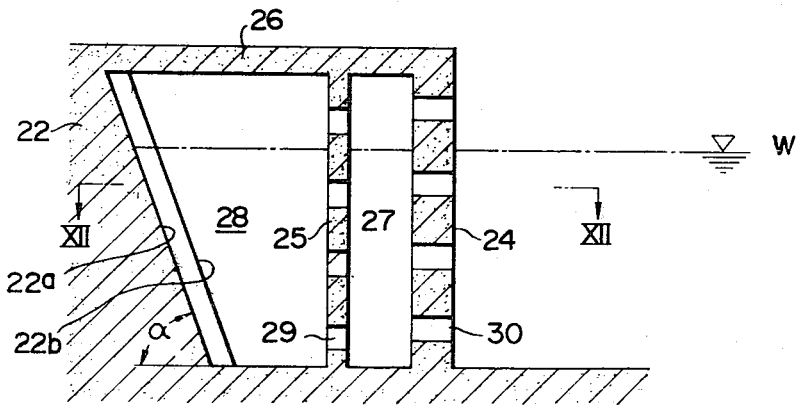
Figure 12:
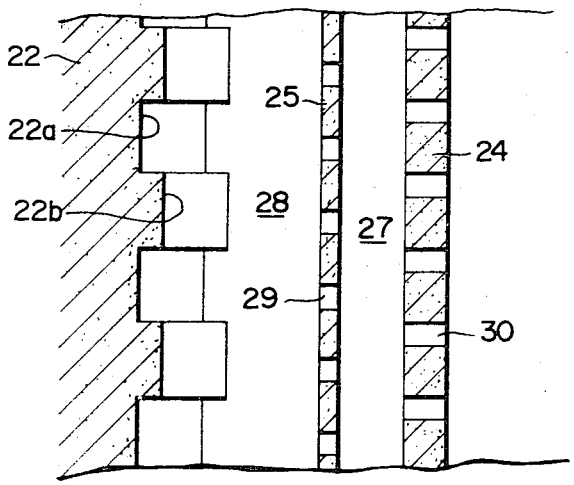
Figure 13:
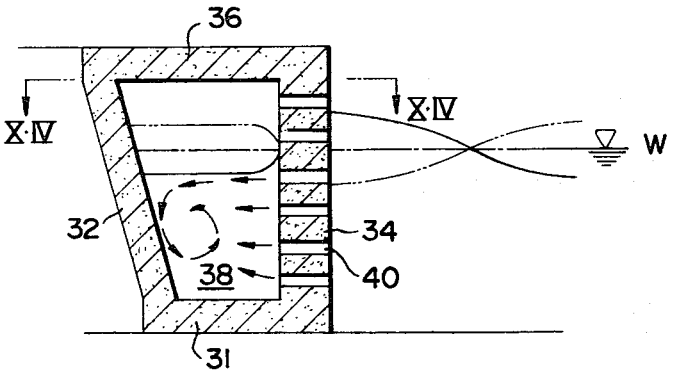
Figure 14:
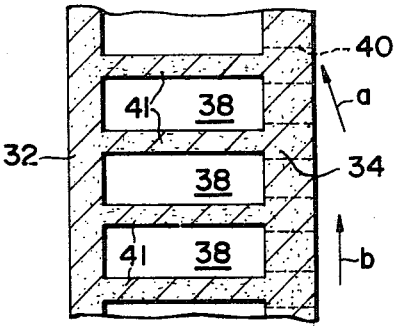
Figure 15:
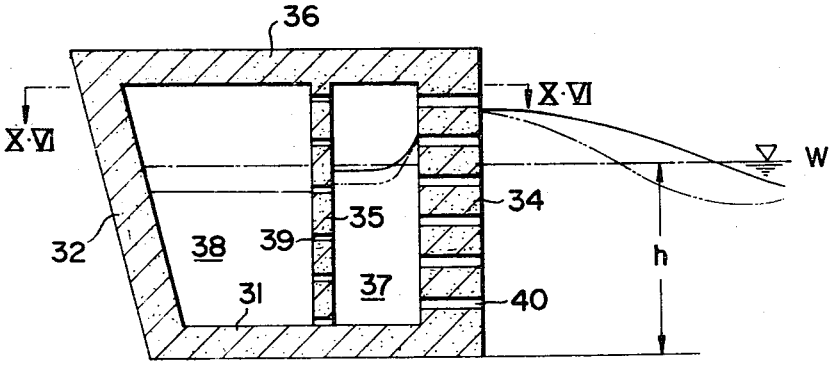
Figure 16:
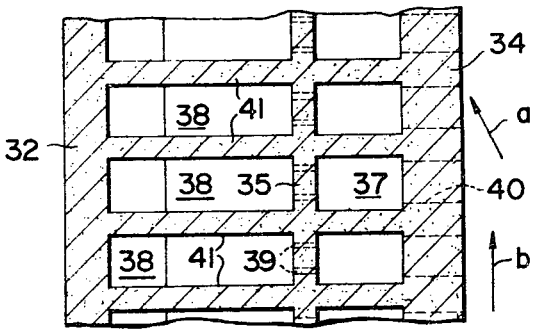

FIG. 5 graphically illustrates the blocking ability of the sea wall shown in FIG. 3;

FIG. 6 is a transverse sectional view of another sea wall according to the present invention;

FIG. 7 is a transverse sectional view of yet another sea wall according to the present invention;

FIG. 8 is a transverse sectional view of another sea wall according to the present invention;

FIG. 9 is a transverse sectional view of another sea wall according to the present invention;

FIG. 10 is a sectional plan view of the sea wall of FIG. 9 taken along the line X—X;

FIG. 11 is a transverse sectional view of another sea wall according to the present invention;

FIG. 12 is a sectional plan view of the sea wall of FIG. 11 taken along the line XII—XII;

FIG. 13 is a transverse sectional view of yet another sea wall according to the present invention;

FIG. 14 is a sectional plan view of the sea wall of FIG. 13 taken along the line XIV—XIV;

FIG. 15 is a transverse sectional view of still another sea wall according to the present invention;

FIG. 16 is a sectional plan view of the sea wall of FIG. 15 taken along the line XVI—XVI;

FIG. 17 is a fragmentary view illustrating typical shapes of the holes which can be used in the front walls of the breakwaters of the present invention.

Figure 1:
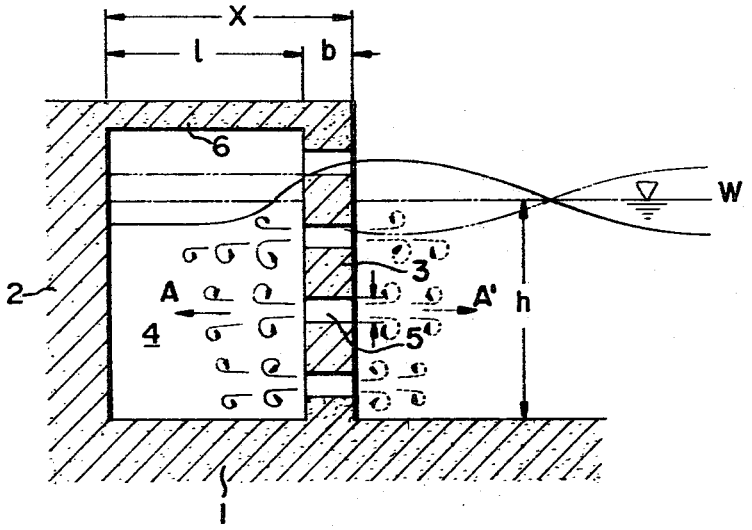

Referring first to a conventional sea wall illustrated in FIG. 1, the sea wall comprises a base 1 set on the sea bottom, an impermeable back wall 2 standing vertically on the base 1, its top end being higher than the water level W, a front wall 3 having a plurality of holes 5 which stands vertically on the base 1 at a certain distance l from the back wall 2 and which has the same height as the back wall 2, a support slab 6 which projects horizontally frontwards from the top end of the back wall 2 and which is connected to the top end of the front wall 3 and a chamber 4 between the back wall 2 and the front wall 3. The upper part of the chamber 4 contains air and vents to the atmosphere and the lower part of the chamber 4 is under the water level W and is filled with water.

When the wave-crest arrives at the front wall 3, as shown in FIG. 1, the water level in front of the front wall 3 rises and the water rushes into the chamber 4 through the holes 5 of the front wall 3 according to the relative water level difference between the chamber 4 and the water in front of the front wall.

Then the energy of the wave is partly converted into energy of vortices A generated at the holes 5.

When the water level in the chamber 4 rises after the half period point of the wave, and the exterior water level drops, as shown in FIG. 1 by two-dotted lines, the water in the chamber 4 rushes out of the chamber 4 through the holes 5, and more of the wave energy is converted into energy of the vortices A' generated at the holes 5.

Thereby the wave is blocked by the sea wall.

The amount of the energy loss of the wave due to the vortices A and A' is in proportion to the cube of the water flow speed through the holes 5. The blocking ability against the wave relates to the thickness b of the front wall 3, the diameter d of the holes 5, the opening ratio V of the front wall 3, and the width l of the chamber 4.

To obtain the maximum blocking ability, that is, to minimize the height of the reflected wave, we find that the best results are obtained when the diameter d of the holes 5 is roughly the same as the wave height $H_i$, i.e., $d \sim H_i$, that the opening ratio V of the front wall 3 is in a range of 20%-35%, that the thickness b of the front wall 3 is in a range of 20%-40% of the water depth h, and the whole width X, which is the sum of the width l of the chamber 4 and the thickness b of the front wall 3, is approximately 15% of the wave length L.

Figure 2:
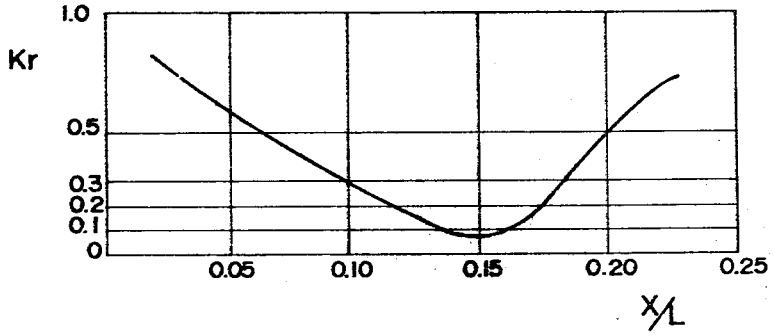

In view of this, if a sea wall is designed with the fixed width X, and the reflectivity $K_r$, i.e., ratio of reflected wave height to incident wave height, is measured for waves of various wave lengths and is plotted on a graph with the reflectivity $K_r$ along the horizontal axis and the ratio X/L along the vertical axis, a graph as shown in FIG. 2 results.

From this graph, it is readily understood that the reflectivity $K_r$ is minimum when X/L is approximately 0.15. Considering that the reflectivity $K_r$ of 0.3 or less is sufficient to obtain a desirably calm state of the water, such a sea wall exhibits remarkably good blocking ability against waves of which the wave length L is approximately X/0.15.

However, the range of wave lengths against which blocking ability is good is rather narrow. When the wave length becomes shorter or longer than the above-mentioned value, the reflectivity $K_r$ increases abruptly. Consequently, it appears that the blocking ability of the conventional sea wall is not enough against a variety of waves having a wide range of wave lengths.

Referring to FIGS. 3 and 4 of the drawings, there is shown a sea wall including a back wall 12 which inclines at an angle $\alpha$ away from the sea, so that its upper part is farther from the sea than its lower part, on a base 11 on the sea bottom. The back wall 12 rises above the water level W.

The first front wall 14 and the second front wall 15, which is situated behind, away from, and parallel to the first front wall 14, stand vertically on the base 11 in front of the inclined back wall 12 and have the same height as the inclined back wall 12.

The top ends of both the first and the second front walls 14 and 15 are integrally connected to a support slab 16 which projects from the top end of the inclined back wall 12.

The first front wall 14 and the second front wall 15 have a plurality of circular holes 20 and 19 respectively, which are uniformly distributed and whose axes are horizontal. The diameter $d_1$ of the holes 20 is larger than the diameter $d_2$ of the holes 19. The holes 20 and 19 are arranged so that none of them have a common axis.

The shape of the holes 19 and 20 might also, in an alternative embodiment of the present invention, be polygonal. In this connection, FIG. 17 merely shows in a fragmentary view, holes of a typical shape, such as circular or polygonal, which may, if desired, be embodied in the breakwaters of the invention.

The thickness $b_1$ of the first front wall 14 is larger than the thickness $b_2$ of the second front wall 15.

The first chamber 17 is defined by the first and the second front walls 14 and 15, the base 11 and the support slab 16, and the second chamber 18 is defined by the second front wall 15, the inclined back wall 12, the base 11, and the support slab 16, as shown in FIG. 3.

The upper part of each of the first and the second chambers 17 and 18 is air-filled and vents to the atmosphere via the holes 19 and 20 and the lower part of each of the chambers 17 and 18 is water-filled and leads to the water via the holes 19 and 20.

The width 1 of the second chamber 18 is larger than the width $b_0$ of the first chamber 17, and, for example, may be several times larger.

The widths l and $b_0$ of the first and the second chambers, the thicknesses $b_1$ and $b_2$ of the first and the second front walls and the diameters $d_1$ and $d_2$ of the holes of the first and the second front walls, mentioned above, may be changed as occasion demands.

When the wave-crest arrives at the first front wall 14, as shown in FIG. 3, the water level before the first front wall 14 rises. Thus, the water rushes into the first chamber 17 through the holes 20 according to the water level difference between the first chamber 17 and the water in front of the first front wall 14. Then the water in the first chamber 17 rushes into the second chamber 18 through the holes 19. The wave energy is partly dissipated into the vortices generated at the holes 19 and 20. The water further rushes against the inclined back wall 12 and vortices turning downwards are generated according to the difference of the upper and the lower water flow speeds since the back wall inclines and the water flow speed is highest in the upper part of the water and decreases gradually as the depth increases. Thus the energy of the wave is further partly converted into energy of the vortices in this chamber.

When the water level in the second chamber 18 rises after the half period point of the wave, and the exterior water level drops, as shown in FIG. 3 by a two-dotted line, the wave-trough arrives at the first front wall 14. The water rushes out of the second chamber 18 to the first chamber 17 through the holes 19 and then out of the first chamber 17 to the outside through the holes 20. The wave is further weakened by the vortices generated at the holes 19 and 20.

As described above, the wave is de-energized by the vortices generated at both the sides of the first and the second front walls 14 and 15, and thereby the wave is blocked by the sea wall. Furthermore, since the holes 19 and 20 are arranged so that none of them have a common axis, the sea wall blocks a variety of waves having a wide range of wave lengths.

The inclined back wall 12 promotes the generation of vortices adjacent to the back wall 12 in the second chamber 18 and minimizes the influence of the bank pressure against the sea wall.

The measured reflectivity of the sea wall shown in FIGS. 3 and 4 is shown in FIG. 5 in the same manner as FIG. 2.

It is readily understood from FIG. 5 compared with FIG. 2 that the sea wall of the present invention exhibits good blocking ability not only to waves having a short wave length but also to waves having a long wave length, and its application range is much wider than that of conventional one.

That is, considering a wave having a short wave length, as apparent from FIG. 5, the reflectivity $K_r$ does not increase much and remains within a range of 0.1–0.2. The reflectivity $K_r$ is generally low with respect to X/L. Consequently, it is apparent that the sea wall of the present invention has a superior blocking ability as compared with FIG. 2.

On the other hand, considering a wave having a long wave length, the first and the second front walls act as a single wall having the width $b=b_0+b_1+b_2$ against the wave and exhibit the minimum value of the reflectivity $K_r$ when X/L is equal to 0.12.

Accordingly, the whole width X is approximately 12% of the wave length L. The sea wall which has a shorter whole width ($X \approx 0.12$ L) than that ($X=0.15$ L) of the conventional sea wall having a single front wall exhibits sufficient blocking ability.

Further, in the conventional sea wall having a single front wall, the energy loss is caused by the vortices generated at both sides of the front wall. However, in the sea wall of the present invention having two front walls, the energy loss is caused by the vortices generated at both sides of both the front walls. Hence, both the thicknesses $b_1$ and $b_2$ of the first and the second front walls 14 and 15 can be formed to be thinner than that of the conventional sea wall.

From this fact, it becomes possible to reduce the amount of the material to be used for the sea wall and the weight of the same as compared with the conventional sea wall.

However, the weight reduction of the sea wall generally causes a strength drop for supporting the sea wall against the bank pressure. In the present invention this is overcome by inclining the back wall at an angle $\alpha$ away from the sea as described above, thereby minimizing the influence of bank pressure.

For example, assuming that the angle $\alpha$ of inclination is 60°, the bank pressure is decreased by 40% as compared with a vertical back wall.

The width L of the second chamber 18 is substantially shortened by inclining the back wall 12. However, this does not reduce the blocking ability of the sea wall. The reason is as follows: As described above, the sea wall exhibits the maximum blocking ability when the whole width X is equal to 0.12 L, in which the whole width X is measured at the calm water level, as shown in FIG. 3.

The closer to the water surface, the faster the horizontal water flow speed in the second chamber 18 becomes, as described above. Hence, considering now a sea wall having a vertical back wall, vortices turning counterclockwise around the horizontal axis, as illustrated in the figure, are generated in the central upper part of the second chamber. But the lower water adjacent to the back wall does not contribute to generating the vortices which dissipate the energy of the wave. Accordingly, even if this non-contributory portion is removed by inclining the back wall away from the sea, the blocking ability of the sea wall does not change or decrease.

Referring to FIG. 6, there is shown another sea wall according to the present invention.

In this case, the thickness of the second front wall 15 is in a range of $\frac{1}{3}$ to $\frac{1}{4}$ of that of the first front wall 14 and the opening ratio of the second front wall 15 is in a range of $\frac{1}{3}$ to $\frac{1}{4}$ of that of the first front wall 14. The width of the first chamber 17 is almost the same as the second chamber 18. The holes 19 of the second front wall 15 are formed only at its lower part under the water level. The second chamber 18 does not vent to the atmosphere but its only exit is to the water of the first chamber 17 via the holes 19. Since the second chamber 18 is closed to the atmosphere, the air existing in the upper part of the second chamber 18 acts as a damper when the water comes in or goes out. Accordingly, the resistance the water undergoes is quite large and the energy loss of the wave is extremely large.

That is, when a wave having a wave length of $L_1=X_1/0.12$ relative to the width $X_1$ which is from the first front wall 14 to the back wall 12 is incident, in accordance with the long wave length the water flows freely through the holes 19 of the second front wall 15 and the second chamber 18 exhibits the same extent of blocking ability as a sea wall including no second front wall.

On the other hand, when a wave having a wave length of $L_2=X_2/0.12$ relative to the width $X_2$ which is from the first front wall 4 to the second front wall 15 is incident, according to the short wave length, the second front wall 15 exhibits a large resistance to the water flow, i.e., a similar action to a wall including no openings. Therefore, against such a wave having a short period, this sea wall exhibits the blocking ability of a sea wall having a whole width of $X_2$.

To block waves having a range of wave lengths from $L_1$ to $L_2$, a sea wall having uniform blocking ability over the range is provided by forming the first and the second front walls so that $X_1$ is approximately equal to 0.12 $L_1$ and $X_2$ is approximately equal to 0.12 $L_2$. For instance, when the water depth h is 8 meters, $L_1$ is 84 meters and $L_2$ is approximately 35 meters, to block waves having a period of 5–10 seconds. Thus, assuming that $X_1$ is approximately 10 meters and $X_2$ is approximately 4.2 meters, a sea wall which exhibits uniform blocking ability ($K_r \approx 0.1$–$0.2$) against such waves is constructed.

Referring to FIG. 7, there is shown another sea wall according to the present invention.

The sea wall is constructed on a base block 40 having height $h_2$ formed on the foundation of the sea bottom.

The depth $h_1$ under the water level of the sea wall is greater than or equal to 30% of the sea depth h.

The base block 40 constitutes a wall for supporting the bank 13 together with the sea wall.

The sea wall is the same as the one shown in FIG. 3 except that the upper part of the back wall 12 which inclines at an angle $\beta$ with respect to the vertical away from the sea, bends frontwards at an angle $\gamma$ with respect to the vertical at the water level.

The vertical front surface of the base block 40 is in the same plane as the vertical front surface of the first front wall 14.

In this case, since the sea wall is constructed on the base block 40, it is very easy to build the sea wall in comparison with one constructed directly on the sea bottom. Further, part of the bank pressure is supported by the base block 40 and the sea wall together with the base block 40 constitutes a rigid wall against the bank pressure.

This sea wall conveniently constructed at a place where the water is deep.

In FIG. 8 there is shown another sea wall according to the present invention. This sea wall has the same construction as the one shown in FIG. 3 except that the second front wall 15 inclines at an angle $\delta$ away from the sea, so that its upper part is closer to the back wall than its lower part. It is apparent that the same results may be obtained as with the sea wall shown in FIG. 3.

In addition, when the wavecrest arrives at the first front wall 14, the water rushes into the first chamber 17 through the holes 20 and then strikes against the second front wall 15. Since the second front wall 15 inclines, and the water pressure P acts perpendicular to it, the horizontal component P′ of the pressure P is equal to P sin $\delta$ and the vertical component P″ of the pressure P is equal to P cos $\delta$. The vertical component P″ contributes to the stability of the sea wall.

Referring to FIGS. 9 and 10, there is shown even yet another sea wall according to the present invention.

This sea wall comprises an inclined back wall 22 on a base 21 which has alternate concave surfaces **22*a* and convex surfaces 22*b* at a certain distance apart from one another in the horizontal direction (longitudinal direction of the breakwater) and which has a greater height than the water level W, a front wall 24 with a plurality of holes 30, which stands vertically on the base 21 at a distance from the back wall 22 and which has the same height as the back wall 22, a support slab 26 which projects horizontally frontwards from the top end of the back wall 22 and which is integrally connected to the top end of the front wall 24, and a chamber 28 between the back wall 22 and the front wall 24**.

The upper part of the chamber 28 vents to the atmosphere and the lower part of the same leads to the sea water via the holes 30.

The width l of the chamber 28 is the mean distance from the rear surface of the front wall 24 to the concave and the convex surfaces **22*a* and 22*b*** at the water level.

The widths m and m′ of the concave and the convex surfaces **22*a* and 22*b* and the projecting distance n of the convex surfaces 22*b* with respect to the concave surfaces 22*a*** may be varied, as occasion demands.

The wave is blocked by the sea wall in the same manner as described above.

The indented back wall 22 promotes the generation of the vortices in the chamber 28.

In FIGS. 11 and 12 there is shown another sea wall according to the present invention.

This sea wall is the same as the one shown in FIG. 3 except that the inclined back wall has alternate concave surfaces 22a and convex surfaces 22b in the horizontal direction at a certain distance apart from one another.

The same results can be obtained as hereinbefore described.

The wave is blocked by the sea wall in the same way as described above.

Referring to FIGS. 13 and 14, there is shown another sea wall according to the present invention.

This sea wall comprises an inclined back wall 32 on a base 31, its top end being higher than the water level, a front wall 34 with a plurality of holes 40 which stands vertically on the base 31 at a distance from the back wall 32 and which has the same height as the back wall 32, a support slab 36 which projects horizontally frontwards from the top end of the back wall 32 and which is connected to the top end of the front wall 34, a chamber 38 between the back wall 32 and the front wall 34, and a plurality of vertical partition walls 41 which cross transversely the whole width of the sea wall at certain intervals in the longitudinal direction.

The upper part of the chamber 38 vents to the atmosphere and the lower part of the same leads to the sea through the holes 40.

The wave is blocked by the sea wall in the same manner as described above, when the incident wave is perpendicular to the sea wall, i.e., the front wall 34.

Further, when a wave incident at an acute angle such as shown in FIG. 14 by an arrow a, or a parallel wave such as shown in FIG. 14 by an arrow b, is incident upon the sea wall, the water surface before the sea wall repeats up and down alternately by the passing wave since the chamber 38 is separated by the partition walls 41 into compartments in the longitudinal direction. The waves are blocked by the sea wall in the same way as the perpendicularly incident waves, due to the provision of the partitions, since water cannot flow from one compartment to the next, although their oscillations are out of phase with one another. It is apparent that an inclined-angle incident wave and a parallel incident wave as well as a perpendicularly incident wave are blocked by the sea wall of the present invention.

In FIGS. 15 and 16 there is shown still another sea wall according to the present invention.

This sea wall has the same construction as the one shown in FIG. 3 except for the addition of a plurality of vertical partition walls 41 which cross transversely the whole width of the sea wall at certain intervals in the longitudinal direction.

The same results are obtained as described above.

An inclined incident wave shown by an arrow a and a parallel incident wave shown by an arrow b as shown in FIG. 16, as well as a perpendicularly incident wave, are blocked by the sea wall of the present invention in the same way as described above.

It is readily understood as described hereinbefore that a variety of waves having a wide range of wavelengths are blocked by the sea wall according to the present invention.

The sea wall of the present invention may be constructed by a conventional manner such as piling up a combination of a variety of blocks, forming same integrally by concrete, i.e., the caisson system, and the like.

Further, although the present invention has been described with particular reference to a sea wall which absorbs the impact of incident waves, it should be understood that it can be applied to any situation where any kind of breakwater to reduce wave impact is required.

I claim:

1. A double breakwater of the semisubmerged type comprising a base on the water bottom; a back wall of generally planar configuration inclined substantially uniformly over its entire length and inclining away from the incident wave direction, so that its upper part is farther from the incident wave direction than its lower part, and the upper part of said inclined back wall rises above the calm water level; its lower part being below the calm water level; a perforated barrier wall structure having a plurality of apertures or holes standing on the base, which has the same height as the inclined back wall; and a top wall support slab which projects horizontally from the top end of the inclined back wall and which is connected to the top of said perforated barrier wall structure, so as to form and completely cover a chamber between said base and said top, and said perforated barrier wall structure and said inclined back wall, and said chamber is adapted to partly retain at all times some of the water entering said chamber so as to aid in damping wave action; whereby said double breakwater exhibits substantially uniform blocking ability against a variety of waves having a broad range of wave length with the wave energy partly dissipated into vortices generated at said apertures or holes in said wall structure and also further partly converted into vortices generated when the water rushes against said inclined back wall.

2. A breakwater according to claim 1, wherein said perforated barrier wall structure comprises at least one vertical front wall.

3. A breakwater according to claim 2, wherein the inclined back wall includes alternate inclined concave surfaces and convex surfaces in the longitudinal direction for the full length of said inclined back wall.

4. A breakwater according to claim 2, further including a plurality of vertical partition walls which cross transversely the whole transverse dimension of the breakwater at certain intervals in the longitudinal direction to form a plurality of compartments between adjacent vertical partition walls.

5. A breakwater according to claim 1, wherein said perforated barrier wall structure comprises a plurality of front walls which are separated from one another and each of which includes a plurality of holes, the dimensions of the holes of the front walls decreasing monotonically from the first wall situated farthest from the back wall to the last wall situated closest to the back wall.

6. A breakwater according to claim 5, wherein said plurality of front walls comprising a first vertical front wall and a second vertical front wall which is situated behind the first vertical front wall, a first chamber being defined between the first and second front walls, and a second chamber being defined between the second front wall and the back wall.

7. A breakwater according to claim 6, wherein the transverse dimension of the first chamber is substantially the same as that of the second chamber, wherein the upper part of the first chamber vents to the atmosphere via the holes in the first front wall and wherein the upper part of said second front wall is devoid of holes above the water level so that the upper part of the second chamber is isolated from the atmosphere and the lower part of the second chamber leads to the water in the first chamber via the holes in the lower part of said second front wall.

8. A breakwater according to claim 5, wherein the base of the breakwater is fixedly disposed upon a base on block secured to the sea bottom.

9. A breakwater according to claim 5, wherein the inclined back wall includes alternate inclined concave surfaces and convex surfaces in the longitudinal direction for the full lenth of said inclined back wall.

10. A breakwater according to claim 5, further including a plurality of apertureless vertical partition walls which cross transversely the whole transverse dimension of the sea wall at certain intervals and form a plurality of compartments between adjacent vertical partition walls and said back wall and the front wall closest thereto.

11. A breakwater according to claim 5, wherein said plurality of front walls comprising a first vertical front wall and a second inclined front wall; said second wall inclining at an angle away from the incident wave so that its upper part is closer to said back wall than its lower part.

12. A breakwater according to claim 5, wherein said plurality of holes in one of said front walls are arranged so that none of them have a common axis with said plurality of holes in another adjacent front wall.

13. A breakwater according to claim 6, wherein the width of the second front wall is smaller than that of said first front wall.

14. A breakwater according to claim 5, wherein the shape of said holes is circular.

15. A breakwater according to claim 5, wherein the shape of said holes is polygonal.

16. A breakwater according to claim 1, wherein said back wall is inclined at an angle of 60° with respect to said base.

* * * * *